US005151743A

United States Patent [19]

Yaguchi

[11] Patent Number: 5,151,743

[45] Date of Patent: Sep. 29, 1992

[54] IMAGE FORMING APPARATUS HAVING FLASH LIGHT FIXING APPARATUS WITH IMPROVED HEAT CHARACTERISTICS

[75] Inventor: Masanori Yaguchi, Oyama, Japan

[73] Assignee: Fujitsu Limited, Kawasaki, Japan

[21] Appl. No.: 637,774

[22] Filed: Jan. 7, 1991

[30] Foreign Application Priority Data

Jan. 18, 1990 [JP] Japan ..... 2-10399

[51] Int. Cl.[5] ..... G03G 15/20

[52] U.S. Cl. ..... 355/288; 219/216

[58] Field of Search ..... 355/282, 285, 286, 288, 355/312, 321; 271/194, 196, 197, 276; 219/216

[56] References Cited

U.S. PATENT DOCUMENTS

| | | | |
|---|---|---|---|
| 4,542,980 | 9/1985 | Tajima | 219/216 X |
| 5,016,060 | 5/1991 | Arai | 355/312 |
| 5,031,002 | 7/1991 | Yaguchi | 355/312 |

FOREIGN PATENT DOCUMENTS

| | | | |
|---|---|---|---|
| 0048861 | 3/1985 | Japan | 271/194 |

OTHER PUBLICATIONS

Stroh, R. D., "Vacuum Paper Drive", IBM Technical Disclosure Bulletin, vol. 20, No. 5, (Oct. 1977), p. 1694.

*Primary Examiner*—A. T. Grimley
*Assistant Examiner*—William J. Royer
*Attorney, Agent, or Firm*—Staas & Halsey

[57] ABSTRACT

An image forming apparatus has a flash light fixing apparatus comprising a flash light fixing unit to irradiate a flash light onto paper to which toner has been transferred, and a paper feed apparatus provided opposite the flash light fixing unit. The paper feed apparatus provides a paper feed mechanism and a paper guide mechanism that guides paper that is fed by the paper feed mechanism. The paper guide mechanism has a plural number of metal plates disposed so that end surfaces thereof oppose the flash light fixing unit. The metal plates are arranged so as to extend in the same direction as the direction of paper feed and so that the end surfaces of the metal plates guide the paper.

11 Claims, 6 Drawing Sheets

IMAGE FORMING APPARATUS HAVING FLASH LIGHT FIXING APPARATUS WITH IMPROVED HEAT CHARACTERISTICS

BACKGROUND OF THE INVENTION

The present invention relates to an image forming apparatus having a flash light fixing apparatus.

One type of image forming apparatus is configured to form a latent image on a surface of a photosensitive drum, transfers toner on that latent image to paper and fix that toner to said paper.

The portion that performs the fixing in the image forming apparatus described above has a fixing apparatus incorporated to it.

One type of fixing apparatus is a flash light fixing apparatus that irradiates flash light and fixes it.

In this flash light fixing apparatus, the temperature of the surface in the member that guides the paper can have its temperature raised easily because of the irradiated flush light.

When the temperature of the paper guide surface rises to above a predetermined temperature, various types of problems that will be described later, occur so that it is necessary for the paper guide mechanism to have a structure whereby the temperature does not rise easily.

FIG. 1 shows an outline configuration of one example of a conventional image forming apparatus 10. The numeral 11 represents a photosensitive drum, and 12 represents a flash light fixing apparatus 12.

The flash light fixing apparatus 12 comprises a flash light fixing unit 13 and a paper feed apparatus 14 provided to the lower side of the flash light fixing unit 13.

The paper feed apparatus 14 comprises a paper feed mechanism 15 comprising suction rotating rollers and a plural number of paper guide apparatus 16 that smoothly guide the fed paper above them.

The paper guide apparatus 16 has a configuration whereby a plural number of long, thin guide plates 17 with a width W1 of about 40 mm are arranged parallel to each other in the direction of paper feed indicated by the arrow 18.

The paper 19 to which the toner on the latent image formed on the surface of the photosensitive drum 11 has been transferred is fed by the paper feed mechanism 15 and is fed through inside the flash light fixing apparatus 12, in a state of being guided by the paper guide apparatus 16. While it is being fed, a flash light is irradiated from the flash light fixing unit 13 to fix the image.

When there is to be printing on both sides of the paper, the paper 19*a* that is sent from the flash light fixing apparatus 12 is fed in the direction shown by the arrow 20. The rear surface of the paper 19*a* is in contact with the photosensitive drum 11 and toner is transferred to the rear surface and then the paper passes through the flash light fixing apparatus 12 and the toner is fixed to the rear of the paper 19*a*.

Flash light is irradiated to the paper guide apparatus 16 and the temperature of the guide surfaces 17*a* of the guide plates 17 rises.

The following problems occur when the temperature of the guide surfaces 17*a* of the guide plates 17 rises.

(1) Of the actions to perform printing on both sides, when there is the process to fix the image on the rear side of the paper, the toner on the front side (lower side) adheres to the guide surfaces 17*a* of the guide plates 17. This adhered toner adheres to the paper that is fed next and dirties the paper and causes the print quality to deteriorate.

(2) There is the danger of the fingers of the operator being burnt when there is operation to remove misfed paper from the flash light fixing apparatus 12.

SUMMARY OF THE INVENTION

Accordingly, it is a general object of the present invention to provide a novel and useful image forming apparatus having flash light fixing apparatus in which the problems described above are eliminated.

Another and more specific object of the present invention is to provide an image forming apparatus having a configuration where a paper guide mechanism having a plural number of metal paper guide plates, guides the paper along the surface at the end.

The paper guide mechanism has a small area which is irradiated by the flash light, and has a large area to dissipate heat and so the rise of the temperature of the paper guide surface is suppressed.

Accordingly, it is possible to prevent the toner from adhering to the guided surface of the paper when printing on both sides is performed and therefore prevent the paper from becoming dirty, and thus prevent deterioration of the print quality, and therefore maintain the initial good print quality for an extended period of time.

In addition, the possibility of the fingers of the operator being burnt when maintenance operation to remove misfed paper from the flash light fixing means is also eliminated.

Another object of the present invention is to provide an image forming apparatus having a paper guide mechanism with a configuration provided with a heat pipe having a heat sink at its end.

The heat pipe having a heat sink at its end portion effectively suppresses the rise in temperature of the paper guide surface.

Accordingly, it is possible to further suppress the rise in temperature of the paper guide surface, definitely prevent the adhering of toner to the paper guide surfaces and thus effectively prevent further deterioration of the print quality.

Other objects of the present invention will become clear from the following detailed description of the present invention, with reference to the accompanying drawings.

DESCRIPTION OF THE PREFERRED EMBODIMENTS

Figure 2:
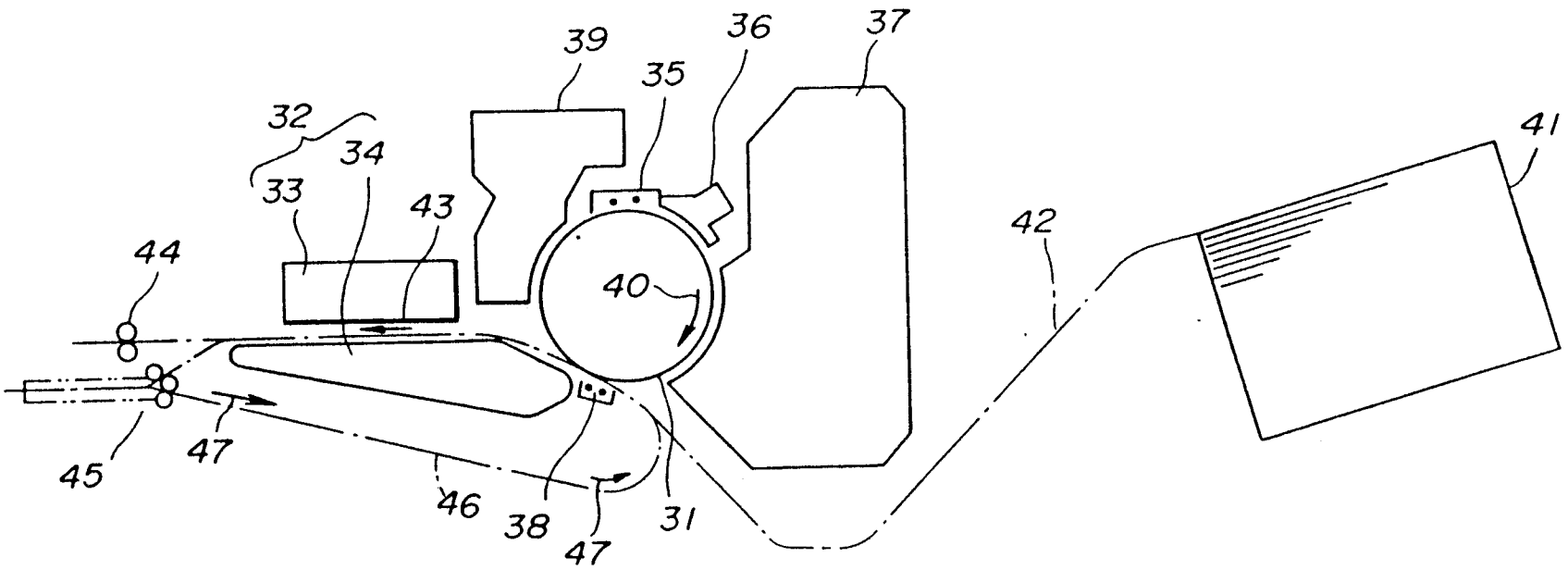
FIG. 2 is a view showing a schematic configuration of an entire image forming apparatus of one embodiment according to the present invention.

FIG. 2 shows a schematic configuration of an entire image forming apparatus 30 of one embodiment according to the present invention.

In the figure, a photosensitive drum 31 is the image retention medium.

Flash light fixing apparatus 32 comprises a flash light fixing unit 33 to irradiate the flash light, and a paper feed apparatus 34 that opposes it on the lower side.

Figure 3:
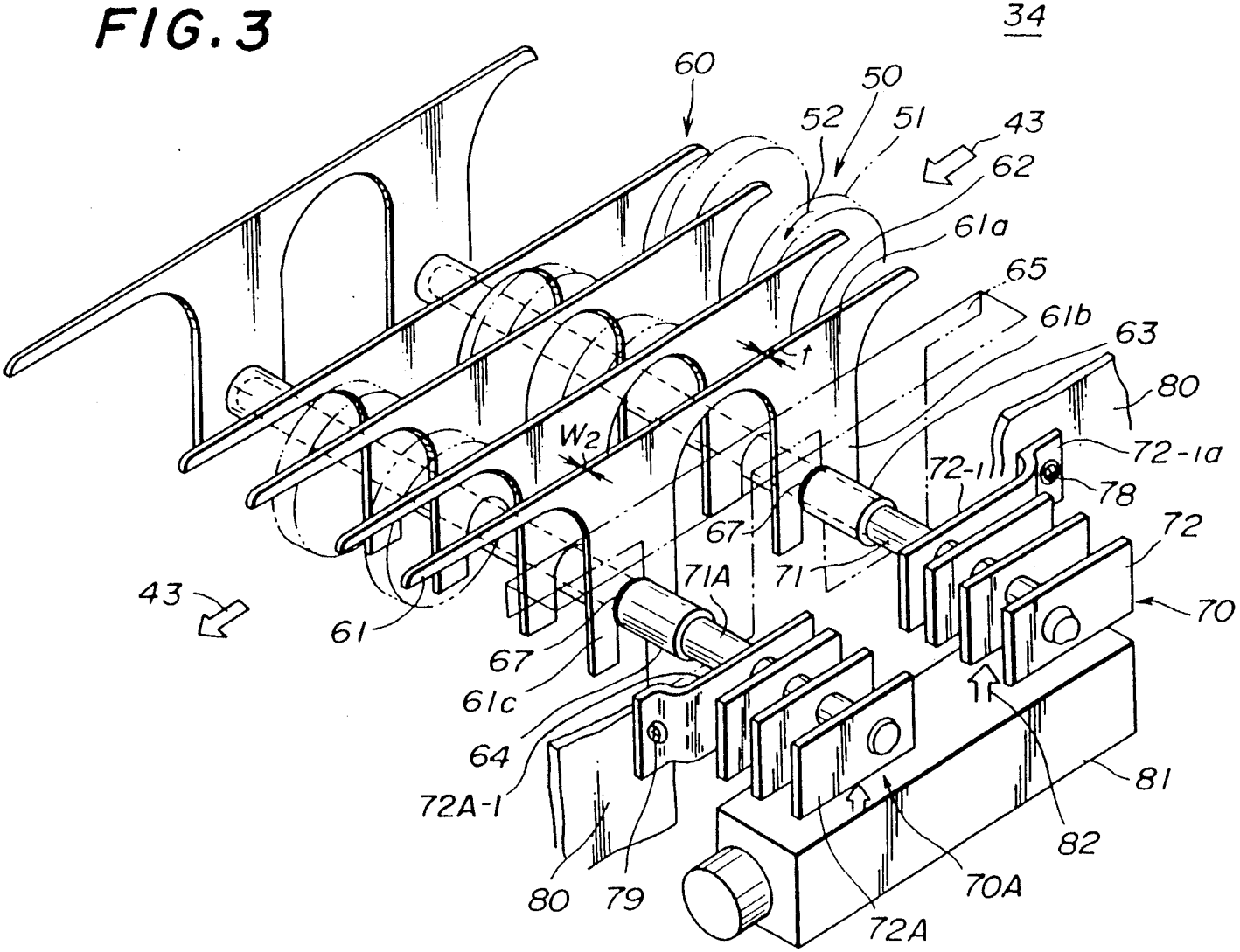
FIG. 3 is a perspective view showing the major portions of a paper feed apparatus according to the present invention.

As shown in FIG. 3, the paper feed apparatus 34 comprises a paper feed mechanism 50 and a paper guide mechanism 60.

Around the periphery of the photosensitive drum 31 shown in FIG. 2 are disposed a precharger 35, an exposer 36, a developer 37, a transfer unit 38 and a cleaner 39.

This image forming apparatus 30 performs printing in the following manner.

The photosensitive drum 31 rotates in the clockwise direction indicated by the arrow 40. The surface of this photosensitive drum 31 is first uniformly charged by the precharger 35 and then the exposer 36 forms a latent image corresponding to the image to be formed. This latent image is developed by the developer 37, to be a toner image, and this toner image is transferred to the paper 42 supplied from the paper supply portion 41, by the transfer unit 38. Then, the paper 42 is fed by the feed apparatus 34 in the direction of the arrow 43, and toner image fixing is performed by the flash light fixing apparatus 32. Then, the paper 42 is discharged by the discharge roller 44 and is fed to a stacker portion (not shown).

The actions described above perform printing to the front surface of the paper 42.

When printing on both sides of the paper is to be performed, the paper that has been fixed by the fixing unit 32 has its feed path switched by the feed path switching means (not shown) and is fed to a paper inverter mechanism 45.

Then, the paper 42 is fed along the path 46 as shown by the arrow 47, and is inverted so that the rear is now at the front, and is fed between the transfer unit 38 and the photosensitive drum 31 in the state where the surface that was the rear surface is now uppermost. Then, the image is transferred to the 'rear' surface and this image is fixed by the fixing unit 33.

Figure 4:
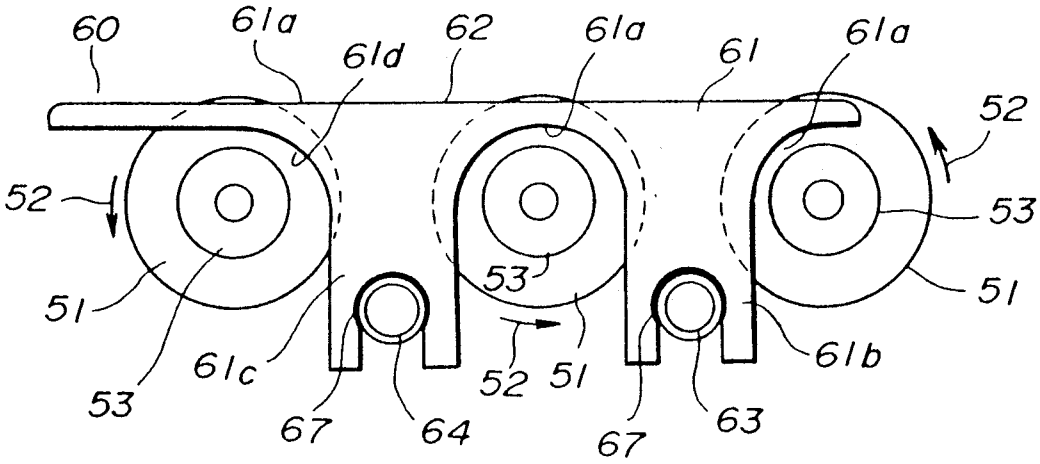
FIG. 4 is a view showing the paper guide mechanism shown in FIG. 3, together with suction rollers.
Figure 5:
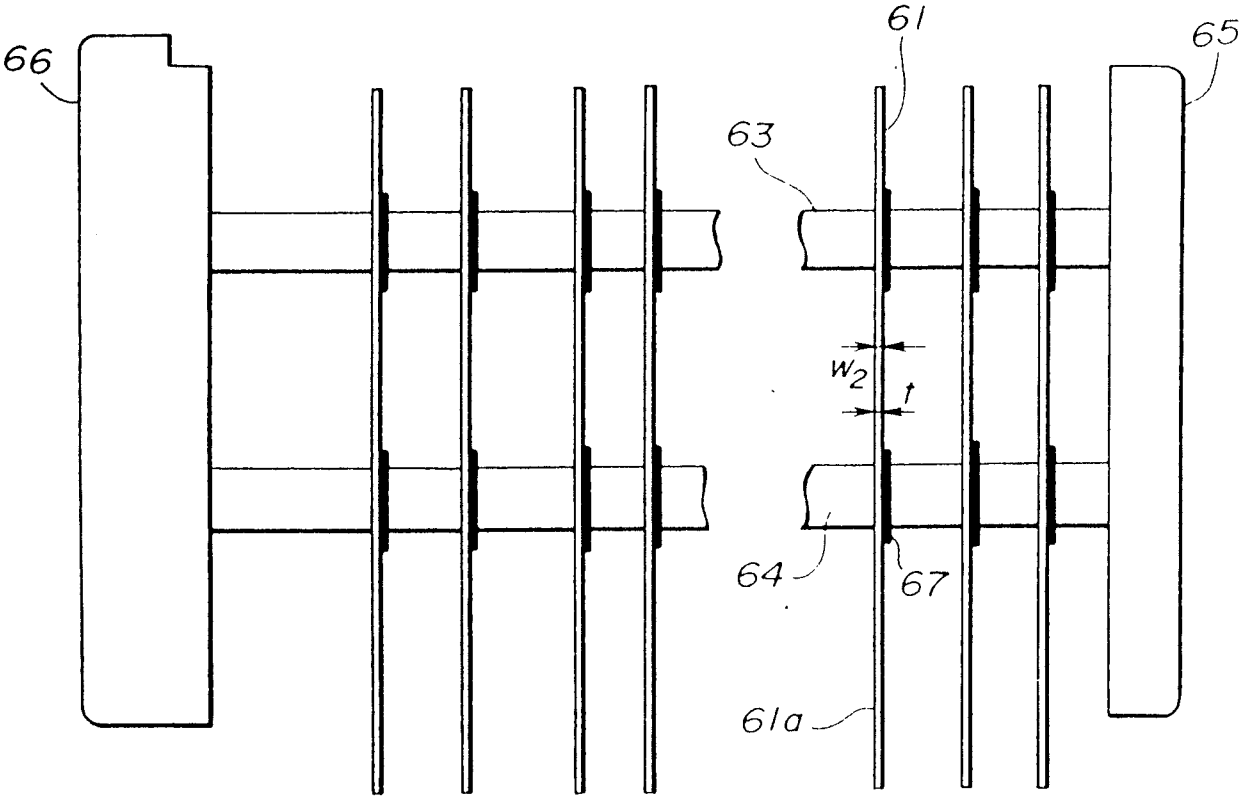
FIG. 5 is a partial cutaway view of the paper guide mechanism in FIG. 3.

The following is a description of the structure of the paper feed apparatus 34 which is one portion of the flash light fixing apparatus 32, with reference to FIG. 3 through FIG. 5.

As has already been described, the paper feed apparatus 34 comprises the paper feed mechanism 50 and the paper guide mechanism 60.

The paper feed mechanism 50 comprises suction rollers 51. As shown in FIG. 3 and FIG. 4, these suction rollers 51 are provided in plural number in three rows in the direction of paper feed 43. More specifically, a plural number of the suction rollers 51 are provided in the direction perpendicular to the paper feed direction 43, while leaving a space between the suction rollers 51 adjacent with each other.

Each of the suction rollers 51 has, around the periphery thereof, a plural number of suction holes. The suction holes coming to the topmost position performs suction action and moves in the direction indicated by the arrow 52 thereby to impart feed force to the paper 42, which is then fed in the direction of the arrow 43.

In FIG. 3, the suction rollers 51 are indicated by chain double-dashed line, due to the convenience of drawing.

As shown in FIG. 4 and FIG. 5, the paper guide mechanism 60 has a structure where a plural number of paper guide plates 61, forming a shape like two letter T's side by side, are disposed vertically and parallel at equal intervals.

Each of the paper guide plates 61 is disposed between suction rollers 51 so that the end surface 61*a* at the top of the letter T is the surface that guides the paper.

Figure 1:
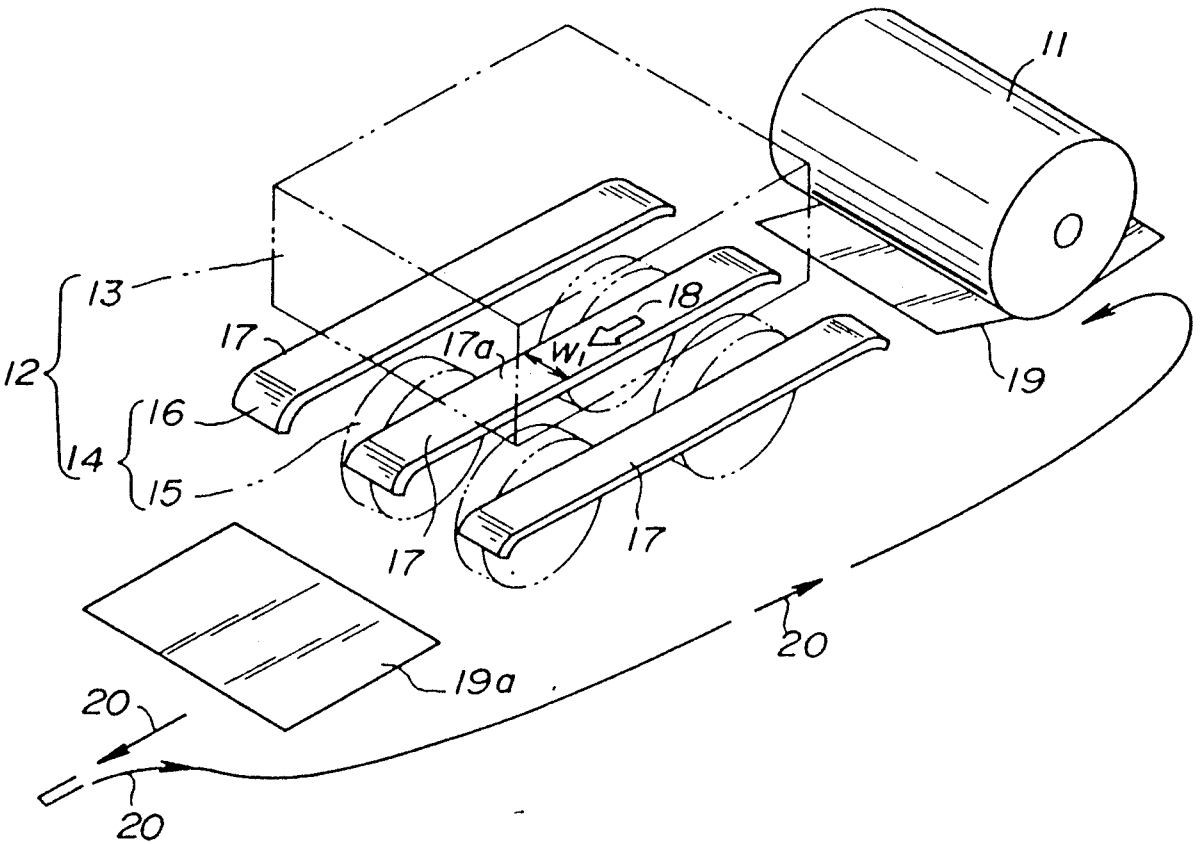
FIG. 1 PRIOR ART
FIG. 1 is an outline configuration view of a conventional image forming apparatus.

The width W2 of the paper guide surfaces 61*a* corresponds to the plate thickness t of the paper guide plate 61 and is approximately 3 to 5 mm, which is approximately 1/10 of a conventional width W1 shown in FIG. 1.

In addition, the paper guide surface 61*a* of the paper guide plate 61 is coated with a TEFLON® film 62 of polytetrafluorethylene. This makes it more difficult for the toner to adhere.

In addition, the paper guide plates 61 are of copper, and have a high coefficient of thermal conductivity.

Furthermore, each of the paper guide plates 61 forms a unit with a pair of leg portions 61*b* and 61*c* through which copper pipes 63 and 64 are attached to form a single unit and both ends of the copper pipes 63 and 64 are soldered to brackets 65 and 66. The portion numbered 67 is also soldered.

The internal diameter of the copper pipes 63 and 64 is slightly larger than 13 mm.

The paper guide mechanism 60 has the brackets 65 and 66 at both ends and fixed at the brackets 65 and 66 to both side plates (not indicated in the figure) of the image forming apparatus 30. Each of the paper guide plates 61 is vertical, and in alignment in the direction 43 of paper feed and between adjacent suction rollers 51.

As shown in FIG. 4, the cutout portion 61*d* of both sides of the leg portions 61*b* and 61*c* of the paper guide plates 61 is a portion for disposing a shaft 53 of the suction roller 51.

As shown in FIG. 4, the leg portions 61*c* extend at portions that do not interfere with the shaft 53, downwards below the shaft 53.

The paper guide surface 61*a* smoothly guides the paper 42 and supports it so that it is not drawn between adjacent suction rollers 51 in the paper feeding direction 42.

Figure 6:
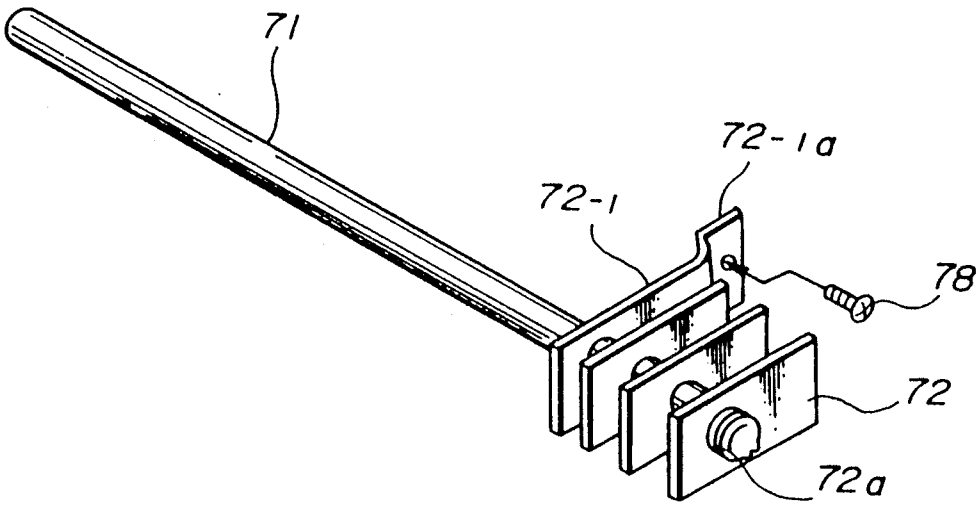
FIG. 6 is a perspective view showing the heat pipe assembly unit of FIG. 3.

In FIG. 3, 70 represents a heat pipe assembly unit. As shown in FIG. 6, to one end of the heat pipe 71 having a diameter of 13 mm and manufactured by Furukawa Electric Co., Ltd. has fixed a plural number (7 or 8) of heat sinks 72 at 5 mm intervals.

These heat sinks 72 have holes 72*a* that are burring processed so as to fixedly engage with the heat pipe 71.

Of the heat sinks 72, the heat sinks 72-1 on the inner side are formed with portions 72-1*a* curved in the shape of a letter Z for the sake of mounting.

The heat pipe assembly unit 70A is the same as the heat pipe assembly 70 described above in that it has a configuration whereby a plural number of heat sinks 72A are fixed to one end of the heat pipe 71A.

As indicated in FIG. 3, in the state where the heat pipe assemblies 70 and 70A are inserted into the copper pipes 63 and 64 respectively, the heat sinks 72-1 and 72A-1 are screw mounted and fixed by to a side plate 80 by screws 78 and 79, and the heat sinks 72 and 72A protrude on the outside of the side plate 80.

A cooling fan 81 is provided on the lower side of the heat sinks 72 and 72A. The cooling fan 81 causes an air stream 82 to blow onto the heat sinks 72 and 72A to provide forced cooling of the heat sinks 72 and 72A.

The following is a description of the operation of the paper guide mechanism 60 described above.

The flash light from fixing unit 33 is irradiated to the paper guide surface 61*a* of the paper guide mechanism 60 and the paper guide plates 61 are heated.

Here, the paper guide surface 61*a* to which the flash light is irradiated is extremely narrow, and has a small area.

In addition, the leg portions 61*b* and 61*c* of the paper guide plates 61 function as heat dissipation portions. The area of the heat dissipation portions is large.

Since each of the paper guide plates 61 has an extremely small area to which the flash light is irradiated and also has a relatively large area from which the heat is dissipated, the paper guide surfaces 61*a* is difficult to heat to a high temperature, when compared to the conventional example Furthermore, the heat of the paper guide plates 61 is favorably conducted to the heat pipes 76 and 71A and is dissipated from the heat sinks 72 and 72A that are being forcedly cooled.

Because of this, the rise of the temperature of the paper guide surfaces 61*a* is further suppressed, and held at a temperature that is sufficiently lower than the temperature at which toner dissolves.

As a result, when there is to be printing on the rear surface of a sheet of paper after the front surface has been printed upon, in the process to feed the paper inside the fixing apparatus 32, toner that is already adhered to the front surface does not adhere to the paper guide surfaces 61*a* even if toner on the front surface rubs the paper guide surfaces 61*a*.

The TEFLON® film 62 of Polytetrafluorethylene also functions to make the toner difficult to adhere to the paper guide surfaces 61*a*.

Because of this, when there is operation to remove misfed paper from inside the flash light fixing unit 32, then there is no possibility of the fingers of the operator being burnt even if the paper guide surface 61*a* is touched.

Moreover, the heat pipe assemblies 70 and 70A described above are units which are separated from the paper guide mechanism 60 and can also be removed so that when there is a failure of some kind in the heat pipe assembly units 70 and 70A, the paper guide mechanism 60 can be left as it is and the failed heat pipe assembly exchanged so enhance maintenability.

Further, the present invention is not limited to these embodiments, but various variations and modifications may be made without departing from the scope of the present invention.

What is claimed is:

1. An image forming apparatus having a flash light fixing apparatus with improved heat characteristics, comprising a flash light fixing unit to radiate a flash light onto paper to which toner has been transferred, and a paper feed apparatus provided opposite the flash light fixing unit said paper feed apparatus comprising a paper feed mechanism and a paper guide mechanism that guides paper that is fed by said paper feed mechanism, said paper guide mechanism comprises a plurality of metal plates vertically disposed, so that edge surfaces thereof are opposite said flash light fixing unit and are arranged so as to extend in the same direction as the direction of said paper feed, said edge surfaces of said metal plates guiding the paper.

2. The image forming apparatus, as claimed in claim 1, wherein said edge surfaces of said plurality of metal plates have a polytetrafluorethylene film.

3. An image forming apparatus having a flash light fixing apparatus comprising a flash light fixing unit to radiate a flash light onto paper to which toner has been transferred, and a paper feed apparatus provided opposite the flash light fixing unit, said paper feed apparatus comprising a paper feed mechanism and a paper guide mechanism that guides paper that is fed by said paper feed mechanism, said paper guide mechanism comprises a plural number of metal plates disposed so that end surfaces thereof oppose said flash light fixing unit and arranged so as to extend in the same direction as the direction of said paper feed, said end surfaces of said metal plates guiding the paper, said paper guide mechanism forms a unit by said plural number of metal plates being soldered to metal pipes, with a heat pipe, having a heat sink fixed at one end thereof, engaging inside said pipes.

4. The image forming apparatus as claimed in claim 3, wherein said paper guide mechanism further has a cooling fan disposed to blow an air stream onto said heat sink.

5. An image forming apparatus having a flash light fixing apparatus comprising a flash light fixing unit to radiate a flash light onto paper to which toner has been transferred, and a paper feed apparatus provided opposite the flash light fixing unit, said paper feed apparatus comprising a paper feed mechanism and a paper guide mechanism that guides paper that is fed by said paper feed mechanism, said paper guide mechanism comprises a plural number of metal plates disposed so that end surfaces thereof oppose said flash light fixing unit and arranged so as to extend in the same direction as the direction of said paper feed, said end surfaces of said metal plates guiding the paper, said paper feed mechanism comprises a plural number of suction rollers that are provided at intervals in a direction perpendicular to the direction of paper feed, said plural number of metal plates having leg portions and being arranged between adjacent suction rollers, and said leg portions being provided to a portion that does not interfere with a shaft of said suction rollers.

6. The image forming apparatus as claimed in claim 5, wherein said plural number of metal plates is soldered, at the position of the leg portions thereof, to metal pipes to form a unit, with a heat pipe, having a heat sink fixed at one end thereof, engaging inside said pipes.

7. An image forming apparatus with improved heat characteristics, comprising:

an image bearing member for bearing a toner image thereon, transferring means for transferring said toner image on said image bearing member to one surface of a paper, a flash light fixing-apparatus having a flash light fixing-unit to radiate a flash light onto said paper to which said toner image has been transferred, and a paper feed apparatus provided opposite said flash light fixing-unit, and means for feeding a paper onto which said toner image has been fixed by said flash light fixing-apparatus, in a state where an edge that was rear is at front along a path bypassing said flash light fixing-apparatus, toward said image bearing member, and in a state where the surface that was another surface of said paper making contact with said image bearing member, so as to perform printing on both sides of said paper;

said paper feed apparatus comprising a paper feed mechanism, and a paper guide mechanism that guides paper that is fed by said paper feed mechanism, said paper guide mechanism comprises a plurality of metal plates vertically disposed, so that edge surfaces thereof are opposite said flash light fixing-unit, and are arranged so as to extend in the same direction as the direction of said paper feed, said edge surfaces of said metal plates having a polytetrafluoroethylene film and guiding the paper.

8. The image forming apparatus, as claimed in claim 7, wherein said paper guide mechanism forms a unit, by said plurality of metal plates being soldered to metal pipes, including a heat pipe, having a heat sink fixed at one end thereof, engaging with said metal pipes.

9. The image forming apparatus, as claimed in claim 8, wherein said paper guide mechanism further has a cooling fan which blows an air stream onto said heat sink.

10. The image forming apparatus, as claimed in claim 7, wherein said paper feed mechanism comprises a plurality of suction rollers provided at intervals in a direction perpendicular to the direction of the paper feed, said plurality of metal plates having leg portions an being arranged between adjacent suction rollers, and said leg portions being provided on a portion that does not interfere with a shaft of said suction rollers.

11. The image forming apparatus, as claimed in claim 10, wherein each metal plate of said plurality of metal plates is soldered, at the position of the leg portions thereof, to metal pipes so as to form a unit, including a heat pipe having a heat sink fixed at one end thereof, engaging with said metal pipes.

* * * * *

UNITED STATES PATENT AND TRADEMARK OFFICE

CERTIFICATE OF CORRECTION

PATENT NO. : 5,151,743

DATED : September 29, 1992

INVENTOR(S) : Masanori Yaguchi et al

It is certified that error appears in the above-indentified patent and that said Letters Patent is hereby corrected as shown below:

Col. 1, line 59, "Flash" should be --A flash--.

Col. 3, line 9, "Flash" should be --A flash--.

Col. 5, line 25, "76 and" should be --71 and--.

Col. 8, line 17, "an" should be --and--.

Signed and Sealed this

Twenty-sixth Day of October, 1993

*Attest:*

*Attesting Officer*

BRUCE LEHMAN

*Commissioner of Patents and Trademarks*